US008678193B2

(12) United States Patent
Grossmann et al.

(10) Patent No.: US 8,678,193 B2
(45) Date of Patent: Mar. 25, 2014

(54) PNEUMATIC FLOTATION MACHINE AND FLOTATION METHOD

(75) Inventors: Lilla Grossmann, Erlangen (DE); Wolfgang Krieglstein, Nürnberg (DE); Sven Menger, Heroldsberg (DE)

(73) Assignee: Siemens Aktiengesellschaft, Munich (DE)

( * ) Notice: Subject to any disclaimer, the term of this patent is extended or adjusted under 35 U.S.C. 154(b) by 21 days.

(21) Appl. No.: 13/380,870

(22) PCT Filed: Apr. 1, 2010

(86) PCT No.: PCT/EP2010/054395

§ 371 (c)(1),
(2), (4) Date: Feb. 22, 2012

(87) PCT Pub. No.: WO2010/149401

PCT Pub. Date: Dec. 29, 2010

(65) Prior Publication Data

US 2012/0145606 A1 Jun. 14, 2012

(30) Foreign Application Priority Data

Jun. 24, 2009 (EP) ..... 09163615

(51) Int. Cl.
*B03D 1/14* (2006.01)

(52) U.S. Cl.
USPC ..... 209/164; 209/166; 209/168

(58) Field of Classification Search
USPC ..... 209/164, 166, 168
See application file for complete search history.

(56) References Cited

U.S. PATENT DOCUMENTS

| | | | | |
|---|---|---|---|---|
| 1,921,220 | A | 8/1933 | Daman | 261/93 |
| 2,238,139 | A | 4/1941 | Tucker | 261/93 |
| 2,612,358 | A | 9/1952 | Daman | 261/93 |
| 2,883,169 | A | 4/1959 | Daman | 261/77 |
| 3,474,902 | A | 10/1969 | Putman | 209/1 |
| 4,331,534 | A | 5/1982 | Barnscheidt | 209/164 |
| 5,219,467 | A * | 6/1993 | Nyman et al. | 209/164 |
| 7,494,016 | B2 * | 2/2009 | Garifulin et al. | 209/164 |
| 2008/0251427 | A1 * | 10/2008 | Mankosa et al. | 209/164 |
| 2010/0051515 | A1 * | 3/2010 | Schneider et al. | 209/164 |

FOREIGN PATENT DOCUMENTS

| | | | | |
|---|---|---|---|---|
| DE | 726709 C | 10/1942 | | |
| DE | 2836496 A1 | 2/1980 | | B03D 1/24 |
| DE | 3312070 A1 | 10/1984 | | B03D 1/14 |

(Continued)

OTHER PUBLICATIONS

International PCT Search Report and Written Opinion, PCT/EP2010/054395, 14 pages, Aug. 3, 2010.

(Continued)

*Primary Examiner* — David H Bollinger
(74) *Attorney, Agent, or Firm* — King & Spalding L.L.P.

(57) ABSTRACT

A pneumatic flotation machine (100) has a housing (1) with a flotation chamber (3), at least one nozzle arrangement (4) for feeding gas and a suspension into the flotation chamber as well as at least one gassing arrangement (5) for feeding further gas into the flotation chamber (3), which arrangement is disposed within the flotation chamber (3) and below the at least one nozzle arrangement (4), wherein there is furthermore at least one adjusting device (9) for changing a position of the at least one gassing arrangement (5) in the flotation chamber (3).

24 Claims, 1 Drawing Sheet

(56) References Cited

FOREIGN PATENT DOCUMENTS

| | | | | |
|---|---|---|---|---|
| GB | 1287274 A | 8/1972 | ..... | G06D 5/02 |
| RU | 2011421 C1 | 4/1994 | ..... | B03D 1/00 |
| SU | 489530 A1 | 10/1975 | ..... | B03D 1/24 |
| SU | 1348844 A1 | 10/1987 | ..... | G06F 13/24 |
| SU | 1377151 A1 | 2/1988 | ..... | B03D 1/14 |
| WO | 2006/069995 A1 | 7/2006 | ..... | B03D 1/02 |

OTHER PUBLICATIONS

Chinese Office Action, Application No. 201080028292, 12 pages, Jun. 20, 2013.

* cited by examiner

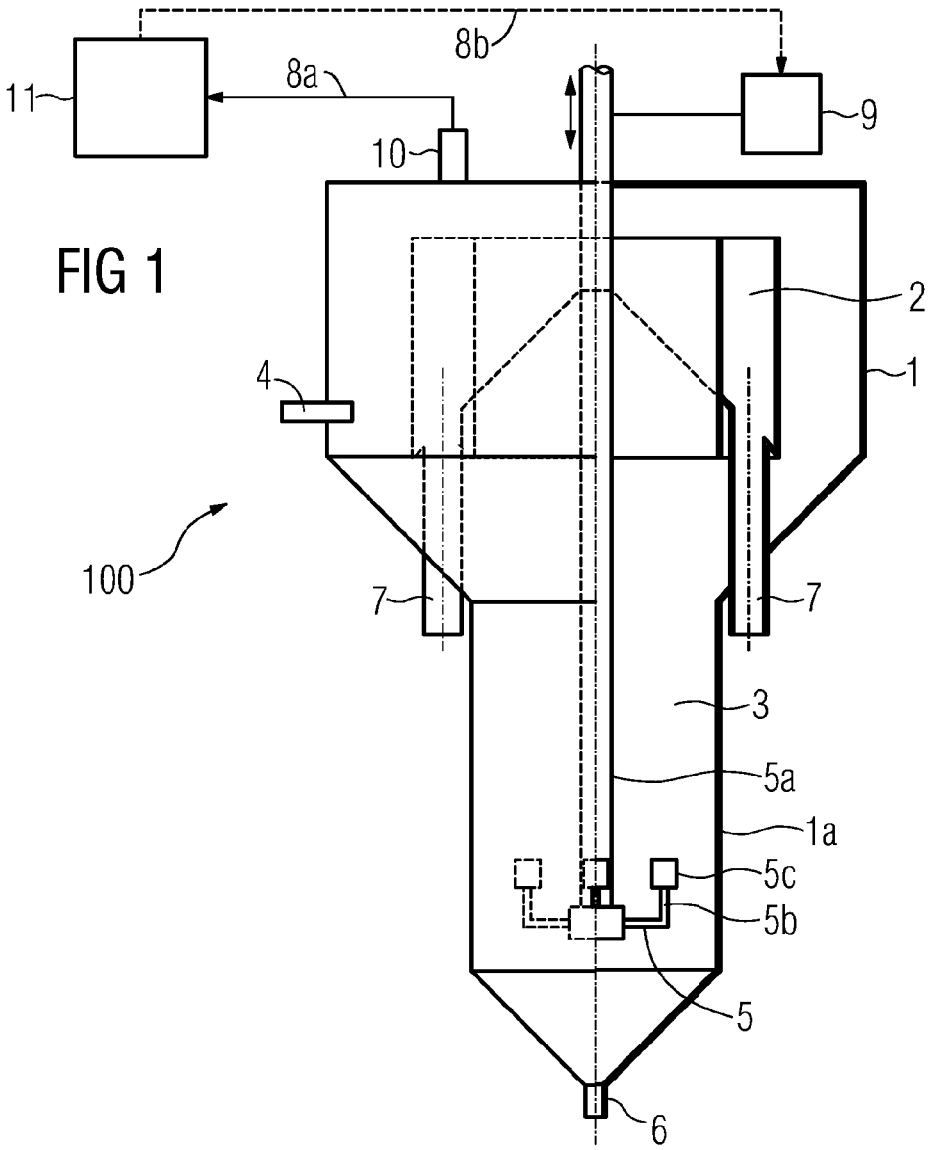
FIG 1
FIG 2
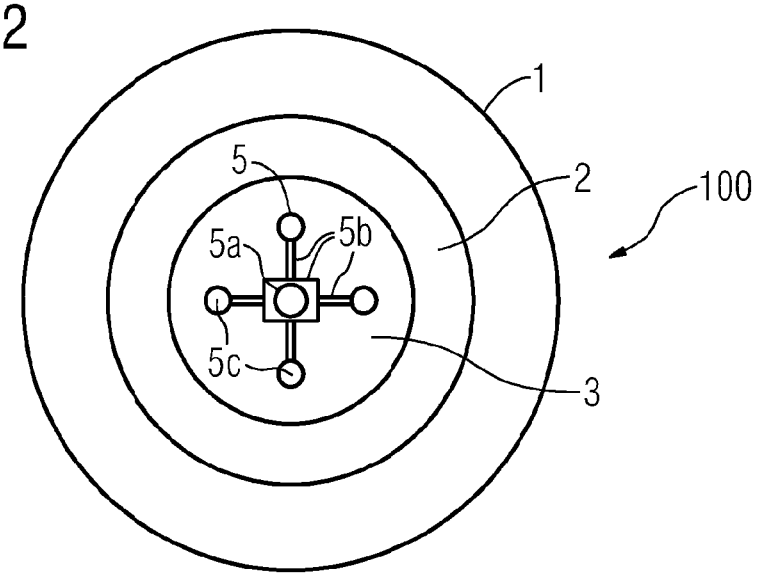

PNEUMATIC FLOTATION MACHINE AND FLOTATION METHOD

CROSS-REFERENCE TO RELATED APPLICATIONS

This application is a U.S. National Stage Application of International Application No. PCT/EP2010/054395 filed Apr. 1, 2010, which designates the United States of America, and claims priority to EP Patent Application No. 09163615.9 filed Jun. 24, 2009. The contents of which are hereby incorporated by reference in their entirety.

TECHNICAL FIELD

The invention relates to a pneumatic flotation machine comprising a housing with a flotation chamber, at least one nozzle arrangement for feeding gas and a suspension into the flotation chamber as well as at least one gassing arrangement for further feeding of gas into the flotation chamber which is arranged in the flotation chamber below the at least one nozzle arrangement, and at least one adjustment device for changing a position of the at least one gassing arrangement in the flotation chamber. The invention further relates to a method for flotation of particles out of a suspension while forming a foam product by means of such a pneumatic flotation machine.

BACKGROUND

Flotation is a physical separation process for separating mixtures of fine-grained solids. such as ores and gangue, in an aqueous froth or suspension with the aid of air bubbles as a result of a different surface wettability of the particles contained in the suspension. They are used for preparing natural resources and for processing preferably mineral materials with a low to medium content of a useful components or a recyclable material, for example in the form of non-ferrous metals, iron, metals of the rare earths and/or noble metals as well as non-metallic natural resources.

Pneumatic flotation machines are known. WO 2006/069995 A1 describes a flotation machine with a housing comprising a flotation chamber, with at least one nozzle arrangement, referred to here as ejectors, also with at least one gassing device, referred to as aerating devices or aerators when air is used, as well a collecting container for foam product formed during the flotation.

DE 33 12 070 A1 describes a flotation cell, in which the gassing of the cloudy material is undertaken by gassing outside the cloudy material, with the inflow direction of the aerated cloudy material able to changed in the vertical and/or lateral direction.

German patent No. 726 709 describes a facility for pneumatic foam-flotation processing of ores, coal and other minerals in which height-adjustable air supply pipes are present.

In pneumatic flotation a suspension of water and fine-grain solid material mixed with reagents is generally introduced via at least one nozzle arrangement into a flotation chamber. The intended effect of these reagents is that especially the valuable particles to be separated by preference are embodied hydrophobically in the suspension. Simultaneously with the suspension the at least one nozzle device is supplied with gas, especially air, which comes into contact with the hydrophobic particles in the suspension. The hydrophobic particles adhere to the gas bubbles that form, so that the gas bubble structures, also called aeroflakes, float and form the foam product on the surface of the suspension. The foam product is discharged into a collecting container and usually concentrated further.

It has been shown that the quality of the foam product or the separation success of the method of pneumatic flotation depends inter alia on the probability of a collision between a hydrophobic particle and a gas bubble. The higher the probability of collision, the greater is the number of hydrophobic particles that adhere to a gas bubble, rise to the surface and form the foam product together with the particles.

One of the factors influencing the probability of a collision is the position of the at least one gassing device in the flotation chamber. In this case the optimum position has previously been selected once as a function of the properties of the suspension used, such as a volume concentration of solids, an ore content, a mineral composition, a particle size distribution etc., as well as the flow conditions in the flotation chamber, and retained over the operating life of the flotation machine.

It has now been shown that these influencing variables change frequently even during the operating life, so that the one-time selection of the position of the at least one gassing device no longer corresponds to the optimum position and the quality of the foam product or the separation performance reduces or fluctuates.

Therefore one of the options previously employed was to change a delivery amount or type of reagents in order to counter a change in the influencing variables. These measures are however only suitable to a restricted extent for maintaining the quality of the foam product or the separation success.

SUMMARY

According to various embodiments, a pneumatic flotation machine or a flotation method can be provided which achieves an improved separation performance if the influencing variables change.

According to an embodiment, a pneumatic flotation machine may comprise a housing with a flotation chamber, at least one nozzle arrangement for feeding gas and a suspension into the flotation chamber as well as at least one gassing arrangement for further feeding of gas into the flotation chamber, which is arranged within the flotation chamber and below the at least one nozzle arrangement, and furthermore at least one adjustment device for changing a position of the at least one gassing arrangement in the flotation chamber, wherein furthermore at least one measuring device for analysis of a formed foam product and/or of the suspension is present and at least one processor unit is present which is connected to the at least one measuring device and wherein the at least one processor unit is configured for calculating and outputting an adjustment variable from analysis values supplied by the at least one measuring device which, in accordance with the position of the at least one gassing arrangement, is able to be changed by means of the at least one adjustment device.

According to a further embodiment, the at least one adjustment device can be connected to the at least one processor unit, and by means of the at least one adjustment device the position of the at least one gassing arrangement is able to be changed automatically as a function of the adjustment variable. According to a further embodiment, the position of the at least one gassing arrangement may be able to be varied vertically and/or horizontally by means of the at least one adjustment device. According to a further embodiment, the at least one gassing arrangement may comprise a gas supply line, a gas distributor system and at least two gas inflow nozzles. According to a further embodiment, the housing may have a cylindrical housing section, of which the axis of symmetry is arranged vertically and wherein the position of the at least one gassing arrangement is able to be changed within the cylindrical housing section. According to a further embodiment, the position of the at least one gassing arrangement may be able to be changed within the cylindrical housing section in the direction of the axis of symmetry by a maximum of 50% of the height of the cylindrical housing section. According to a further embodiment, the gas supply line can be arranged along the axis of symmetry and centered on the latter. According to a further embodiment, the at least one measuring device can be located in the housing.

According to another embodiment, in a method for flotation of particles from a suspension while forming a foam product by means of a pneumatic flotation machine, as described above, a position of the at least one gassing arrangement within the flotation chamber is changed by means of the at least one adjustment device during the flotation, and by means of the at least one measuring device an analysis of the foam product and/or of the suspension is carried out and the position of the at least one gassing arrangement in the flotation chamber is changed by means of the at least one adjustment device as a function of the analysis.

According to a further embodiment of the method, the position of the at least one gassing arrangement in the flotation chamber is changed by means of the at least one adjustment device as a function of the analysis, such that a maximum separation performance of the flotation machine is achieved each time. According to a further embodiment of the method, an adjustment variable can be calculated and output from analysis values supplied by the at least one measuring device by means of the at least one processor unit, in accordance with which the position of the at least one gassing arrangement is changed. According to a further embodiment of the method, the position of the at least one gassing arrangement can be changed automatically as a function of the adjustment variable. According to a further embodiment of the method, an analysis of a foam height of the foam product and/or of a solid content of the foam products and/or of a recyclable material content of the foam product and/or of a bubble size on the surface of the foam product and/or of a solid content of the suspension can be carried out by means of the at least one measuring device.

BRIEF DESCRIPTION OF THE DRAWINGS

FIGS. 1 and 2 are intended to show typical examples of an flotation machine and the way in which it operates according to various embodiments.

The figures show

FIG. 1 a schematic diagram of a pneumatic flotation machine in cross-section; and FIG. 2 an overhead view of the pneumatic flotation machine depicted in FIG. 1.

DETAILED DESCRIPTION

According to various embodiments, the pneumatic flotation machine may comprise a housing with a flotation chamber, at least one nozzle arrangement for feeding of gas and a suspension into the flotation chamber as well as the at least one gassing arrangement for further feeding of gas into the flotation chamber which is arranged within the flotation chamber and below the at least one nozzle arrangement, and at least one adjustment device for changing a position of the at least one gassing arrangement within the flotation chamber, in that in addition at least one measuring device for analysis of a foam product formed and/or of the suspension is present and at least one processor unit is present which is connected to the at least one measuring device, whereby the at least one processor unit is configured to compute an adjustment variable from the analysis values delivered by the at least one measuring device and output them, in accordance with which the position of the at least one gassing arrangement is able to be changed by means of the at least one adjustment device.

According to further embodiments, in a method for flotation of particles from a suspension while forming a foam product, by means of an pneumatic flotation machine, a position of the at least one gassing arrangement is changed within the flotation chamber by means of the at least one adjustment device during the flotation, and by means of the at least one measuring device an analysis of the foam product and/or of the suspension is carried out and the position of the at least one gassing arrangement in the flotation chamber is changed by means of the at least one adjustment device, depending on the analysis.

The flotation machine and the method according to various embodiments make it possible to change the position of the at least one gassing arrangement during the operation of the flotation machine continuously and flexibly adapted to changing influencing variables, especially changing properties of the suspension used and flow conditions in the flotation chamber. This makes possible a positioning of the at least one gassing device such that the gas bubbles are issued at all times directly in the flow line(s) which bear an increased number of particles. This keeps the probability of a gas bubble colliding with a hydrophobic particle continuously at the same level and thereby the separation success is maintained or even increased despite changing influencing variables. The separation performance of the flotation machine can thus be optimized online as a function of the analysis values. The result is an increase of the overall yield during flotation with optimum utilization of the plant capacity.

The at least one gassing arrangement, by means of which gas, but not a suspension can be introduced into the flotation chamber, enables the quantity of gas to be varied as required and greatly increased without a supplied quantity of suspension having to be changed in the flotation chamber. This evens out the flotation process and increases the yields to a surprising extent.

If necessary a change in the supplied quantity of reagents to the suspension can be dispensed with and additional costs for a disproportionate use of reagents can be avoided. For a change in the influencing variables a combination of the method according to various embodiments with an adaptation of the supplied quantity and/or type of reagents can frequently however increase the performance of the flotation machine even further.

Existing flotation machines can be upgraded in a simple manner accordingly and their performance improved by various embodiments.

The monitoring of changes in the suspension and/or the foam product can be automated in a simple manner by means of the at least one measuring device for analysis of a formed foam product and/or of the suspension. In particular permanent monitoring of the foam product and/or the suspension is carried out so that reaction is possible to rapid changes in the influencing variables.

The position of the at least one gassing arrangement in the flotation chamber is preferably changed by means of the at least one adjustment device as a function of the analysis such that a maximum separation performance of the flotation machine is obtained each time.

The adjustment variable calculated by the at least one processor unit makes possible a direct and especially rapid optimization of the position of the at least one gassing arrangement, since the adjustment device only has to be adjusted by the amount predetermined by the adjustment variable. The yield overall is noticeably increased by this.

Overall the productivity of the flotation machine thus improves considerably. Continuous operation does not demand any operating personnel on site and the facility is extremely operationally secure. This enables savings to be made in personnel costs.

Preferably the at least one adjustment device is also connected to the at least one processor unit, wherein the position of the at least one gassing arrangement is able to be changed automatically by means of the at least one adjustment device as a function of the adjustment variable. To this end the at least one adjustment device preferably has a drive motor which changes the position of the at least one gassing device in the flotation chamber in accordance with the adjustment variable.

The adjustment device can alternatively also be able to be activated manually and for example can comprise a crank, a lever or the like actively connected to a linkage, especially a toothed linkage, a cable control system or the like.

The position of the at least one gassing arrangement is able to be changed by means of the at least one adjustment device, especially vertically and/or horizontally. This enables the distance covered by the gas bubbles, when floating towards the surface in the suspension, to be changed and lengthened or shortened during this movement.

The at least one gassing arrangement preferably comprises a gas supply line, a gas distributor system and at least two gas inflow nozzles. The gas, especially air, is conveyed in this case via the gas supply line into the flotation chamber, fed into the gas distributor system and distributed there to the individual gas inflow nozzles in proportions as equal as possible.

In this case a change solely or essentially to the position of the gas inflow nozzles of such a gassing arrangement is already understood as a change in the position of the gassing arrangement. The position of the gas supply line and/or the gas distributor system essentially remains the same in such cases.

As an alternative it is possible for a gassing arrangement to be formed solely from a gas inflow nozzle which is connected directly to its own gas supply line. The gas distributor system can be dispensed with in such cases. Such a gassing arrangement can for example be arranged movably directly on the wall of the housing in the area of the flotation chamber.

In an embodiment the housing has a cylindrical housing section, of which the axis of symmetry is arranged vertically, wherein the position of the at least one gassing arrangement is able to be varied within the cylindrical housing section. In particular in this case the position of the at least one gassing arrangement within the cylindrical housing section is able to be changed in the direction of the axis of symmetry by a maximum of 50% of the height of the cylindrical housing section.

The gas supply line of the at least one gassing arrangement is arranged in this case preferably along the axis of symmetry and centered on said axis. This creates an optimum freedom of movement and makes it possible to change the position of the gassing arrangement in an especially simple and uncomplicated manner.

The at least one measuring device can be located inside or outside the housing. To obtain the shortest possible reaction times a proven approach has been to dispose the at least one measuring device within the housing.

In the method according to various embodiments an analysis of the foam product and/or of the suspension is carried out by means of the at least one measuring device and the position of the at least one gassing arrangement in the flotation chamber is changed by means of the at least one adjustment device as a function of the analysis. The continuous monitoring of the influencing variables makes possible a direct and timely adaptation of the position of the at least one gassing arrangement when it is being changed.

An adjustment variable, in accordance with which the position of the at least one gassing arrangement will be changed, is computed and output by means of the at least one processor unit from the analysis values provided by the at least one measuring device. In particular the position of the at least one gassing arrangement is changed automatically as a function of the adjustment variable.

A proven approach has been for an analysis of a foam height of the foam product and/or of the solid content of the foam product and/or of a recyclable material content of the foam product and/or of a bubble size on the surface of the foam product and/or of a solid content of the suspension to be carried out by means of the at least one measuring device. As an alternative the viscosity of the suspension, its recyclable material content etc. can also be analyzed to make it possible to deduce the optimum position of the at least one gassing device, especially of its gas inflow nozzles, in the suspension.

FIG. 1 shows a pneumatic flotation machine 100 with a housing 1 comprising a flotation chamber 3. Located within the flotation chamber 3 is a foam channel 2 with spouts 7 for removal of the foam product formed. The flotation chamber 3 is equipped with at least one nozzle arrangement 4 for feeding gas, especially air, and a suspension into the flotation chamber 3. The housing 1 has a cylindrical housing section 1*a*, at the lower end of which a gassing arrangement 5 is disposed. The housing 1 has a base discharge opening 6. The upper edge of the outer wall of the housing 1 is located above the upper edge of the foam channel 2, which prevents the foam product overflowing over the upper edge of the housing 1. Particles of the suspension, which are provided with an insufficiently hydrophobic surface or have not collided with a gas bubble for example and also hydrophilic particles sink towards the base discharge opening 6. Additional gas, especially air, is blown by means of the gassing device 5 into the cylindrical housing section 1*a*, so that further hydrophobic particles are bound thereto and rise. In the ideal case primarily the hydrophilic particles sink further down and are removed via the base discharge opening 6. The foam product arrives in the foam channel 2 from the flotation chamber 3 and is taken away by the nozzles 7 and concentrated if necessary.

The gassing device 5 comprises in this embodiment a gas supply line 5*a*, a gas distributor system 5*b* and four gas inflow nozzles 5*c*. A schematically depicted adjustment device 9 engages here on the gas supply line 5*a* in order to change the position of the gassing arrangement 5 in the flotation chamber 3, here in particular by vertical (see double arrows) raising or lowering.

Arranged above the foam channel 2 is a measuring device 10 by means of which for example an analysis of the foam height of the foam product in the foam channel 2 or of a solid content of the foam product is carried out.

The measuring device 10 is connected via a data line 8*a* with a processor unit 11 via which analysis or measured values determined during the analysis are transferred to the processor unit 11. Stored in the processor unit 11 are comparison values with which the measured values are compared. If an impermissibly large deviation of the measured values from the comparison values is determined, an adjustment variable, which specifies a required change in the position of the gassing arrangement, 5 is calculated and output by the processor unit 11. The required position change can now for example be carried out manually by means of the adjustment device 9.

As an alternative the adjustment variable can be transferred via a further data line 8*b* to the adjustment device 9 and the required position change can be carried out automatically by means of the adjustment device 9.

FIG. 2 shows the pneumatic flotation machine 100 viewed from above, wherein for reasons of clarity the adjustment device 9, the measuring device 10 and the processor unit 11 have been omitted from the diagram.

The pneumatic flotation machine shown in FIGS. 1 and 2 merely represents an example in this case of a plurality of suitable flotation machines which the person skilled in the art could configure in accordance with the invention. Thus the suitable flotation machines can differ in respect of the design and arrangement of the foam collector, the number of nozzle arrangements for injecting suspension and gas, the number, arrangement and functioning of the adjustment devices for changing the position of the gassing arrangement(s), the number, type and arrangement of measuring devices, the design of the gassing arrangement etc., without departing from the basic idea of the invention.

What is claimed is:

1. A pneumatic flotation machine, comprising:

a housing with a flotation chamber, at least one nozzle arrangement for feeding gas and a suspension into the flotation chamber, at least one gassing arrangement for further feeding of gas into the flotation chamber, the at least one gassing arrangement being arranged within the flotation chamber and below the at least one nozzle arrangement, at least one adjustment device for changing a position of the at least one gassing arrangement in the flotation chamber, at least one measuring device for generating analysis values associated with one or more properties of at least one of a formed foam product and of the suspension, at least one processor unit connected to the at least one measuring device, and wherein the at least one processor unit is configured for calculating and outputting an adjustment variable from analysis values supplied by the at least one measuring device, and wherein the at least one adjustment device is configured to adjust the position of the at least one gassing arrangement in the flotation chamber as a function of the calculated adjustment variable.

2. The pneumatic flotation machine according to claim 1, wherein the at least one adjustment device is connected to the at least one processor unit, and wherein by means of the at least one adjustment device the position of the at least one gassing arrangement is able to be changed automatically as a function of the adjustment variable.

3. The pneumatic flotation machine according to claim 1, wherein the position of the at least one gassing arrangement is able to be varied at least one of vertically and horizontally by means of the at least one adjustment device.

4. The pneumatic flotation machine according to claim 1, wherein the at least one gassing arrangement comprises a gas supply line, a gas distributor system and at least two gas inflow nozzles.

5. The pneumatic flotation machine according to claim 1, wherein the housing has a cylindrical housing section, of which the axis of symmetry is arranged vertically and wherein the position of the at least one gassing arrangement is able to be changed within the cylindrical housing section.

6. The pneumatic flotation machine according to claim 5, wherein the position of the at least one gassing arrangement is able to be changed within the cylindrical housing section in the direction of the axis of symmetry by a maximum of 50% of the height of the cylindrical housing section.

7. The pneumatic flotation machine according to claim 5, wherein the gas supply line is arranged along the axis of symmetry and centered on the latter.

8. The pneumatic flotation machine according to claim 1, wherein the at least one measuring device is located in the housing.

9. A method for flotation of particles from a suspension while forming a foam product by means of a pneumatic flotation machine comprising a housing with a flotation chamber, at least one nozzle arrangement as well as at least one gassing arrangement, which is arranged within the flotation chamber and below the at least one nozzle arrangement, and furthermore at least one adjustment device, wherein furthermore at least one measuring device for analysis of at least one of a formed foam product and of the suspension is present and at least one processor unit is present which is connected to the at least one measuring device and, the method comprising:

changing a position of the at least one gassing arrangement within the flotation chamber using the at least one adjustment device during the flotation, using the at least one measuring device to perform an analysis of one or more variables associated with at least one of the foam product and of the suspension, and changing the position of the at least one gassing arrangement in the flotation chamber using the at least one adjustment device as a function of the analysis.

10. The method according to claim 9, wherein the position of the at least one gassing arrangement in the flotation chamber is changed by means of the at least one adjustment device as a function of the analysis, such that a maximum separation performance of the flotation machine is achieved each time.

11. The method according to claim 9, wherein an adjustment variable is calculated and output from analysis values supplied by the at least one measuring device by means of the at least one processor unit, in accordance with which the position of the at least one gassing arrangement is changed.

12. The method according to claim 11, wherein the position of the at least one gassing arrangement is changed automatically as a function of the adjustment variable.

13. The method according to claim 9, wherein an analysis of at least one of a foam height of the foam product, of a solid content of the foam products, of a recyclable material content of the foam product, of a bubble size on the surface of the foam product, and of a solid content of the suspension is carried out by means of the at least one measuring device.

14. The method according to claim 9, comprising: calculating and outputting an adjustment variable from analysis values supplied by the at least one measuring device which, in accordance with the position of the at least one gassing arrangement, is able to be changed by means of the at least one adjustment device.

15. The method according to claim 9, wherein the at least one adjustment device is connected to the at least one processor unit, and wherein by means of the at least one adjustment device the position of the at least one gassing arrangement is able to be changed automatically as a function of the adjustment variable.

16. The method according to claim 9, wherein the position of the at least one gassing arrangement is able to be varied at least one of vertically and horizontally by means of the at least one adjustment device.

17. The method according to claim 9, wherein the at least one gassing arrangement comprises a gas supply line, a gas distributor system and at least two gas inflow nozzles.

18. The method according to claim 9, wherein the housing has a cylindrical housing section, of which the axis of symmetry is arranged vertically and wherein the position of the at least one gassing arrangement is able to be changed within the cylindrical housing section.

19. The method according to claim 18, wherein the position of the at least one gassing arrangement is able to be changed within the cylindrical housing section in the direction of the axis of symmetry by a maximum of 50% of the height of the cylindrical housing section.

20. The method according to claim 18, wherein the gas supply line is arranged along the axis of symmetry and centered on the latter.

21. A pneumatic flotation machine, comprising:

a housing with a flotation chamber;

at least one nozzle arrangement for feeding gas and a suspension into the flotation chamber;

at least one gassing arrangement for further feeding of gas into the flotation chamber, the at least one gassing arrangement arranged within the flotation chamber and below the at least one nozzle arrangement;

at least one adjustment device for changing a position of the at least one gassing arrangement in the flotation chamber, at least one measuring device for generating analysis values associated with one or more measured properties of at least one of a formed foam product and of the suspension; and at least one processor unit connected to the at least one measuring device and configured to calculate an adjustment variable from analysis values supplied by the at least one measuring device, the adjustment variable being used by the at least one adjustment device for changing the position of the at least one gassing arrangement.

22. A pneumatic flotation machine in accordance with claim 21, the one or more measured properties comprising at least one of a foam height of the foam product and/or of a solid content of the foam products and/or of a recyclable material content of the foam product and/or of a bubble size on the surface of the foam product and/or of a solid content of the suspension.

23. A method for flotation of particles from a suspension while forming a foam product with a pneumatic flotation machine, the method comprising:

analyzing one or more variables associated with measured properties of at least one of the foam product and the suspension, and changing a position of at least one gassing arrangement in a flotation chamber of the pneumatic flotation machine as a function of the analysis.

24. The method in accordance with claim 23, the one or more measured properties comprising at least one of a foam height of the foam product and/or of a solid content of the foam products and/or of a recyclable material content of the foam product and/or of a bubble size on the surface of the foam product and/or of a solid content of the suspension.

* * * * *